US005636608A

United States Patent [19]

Shichinohe et al.

[11] Patent Number: 5,636,608

[45] Date of Patent: Jun. 10, 1997

[54] POWER UNIT FOR A VEHICLE

[75] Inventors: Takashi Shichinohe; Sumiko Fukuzawa; Toshio Shimada; Yukio Ishiuchi, all of Wako, Japan

[73] Assignee: Honda Giken Kogyo Kabushiki Kaisha, Tokyo, Japan

[21] Appl. No.: 501,434

[22] Filed: Jul. 12, 1995

[30] Foreign Application Priority Data

Jul. 13, 1994 [JP] Japan ..... 6-184102
Jul. 13, 1994 [JP] Japan ..... 6-184103

[51] Int. Cl.[6] ..... F02B 67/06; F02F 7/00

[52] U.S. Cl. ..... 123/197.1; 123/195 AC

[58] Field of Search ..... 123/197.1, 195 P, 123/195 AC

[56] References Cited

U.S. PATENT DOCUMENTS

| | | | |
|---|---|---|---|
| 2,127,384 | 8/1938 | Anthony | 123/197.1 |
| 4,550,698 | 11/1985 | Konneker | 123/195 AC |
| 4,692,123 | 9/1987 | Tada et al. | 123/195 P |
| 4,811,705 | 3/1989 | Ono et al. | 123/195 AC |
| 4,846,124 | 7/1989 | Suzuki et al. | 123/195 P |
| 5,078,105 | 1/1992 | Ito et al. | 123/195 AC |
| 5,195,608 | 3/1993 | Morikawa et al. | 123/195 AC |

FOREIGN PATENT DOCUMENTS

| | | | |
|---|---|---|---|
| 63-137087 | 6/1988 | Japan . | |
| 63-125139 | 8/1988 | Japan . | |
| 3-130534 | 6/1991 | Japan | 123/195 AC |
| 289694 | 8/1973 | U.S.S.R. | 123/195 AC |

*Primary Examiner*—David A. Okonsky
*Attorney, Agent, or Firm*—Armstrong, Westerman, Hattori, McLeland & Naughton

[57] ABSTRACT

A power unit for a vehicle constructed by combining an internal combustion engine and a transmission integrally is provided. A crankshaft rotatably supported in front and rear crankcases of the internal combustion engine is positioned biased slightly toward right side from the center of the crankcases, a cylinder block and a cylinder head is inclined toward the left so as to extend obliquely leftward and upward from the crankshaft, on the left side of the crankshaft are arranged a main shaft and an auxiliary shaft of the transmission in turn, at a middle and upper portion between the main and auxiliary shafts a reverse shaft, and below the auxiliary shaft a driving shaft. On the right side of the crankshaft is arranged a cam shaft. These shafts are parallel with each other and directed in the vehicle running direction.

3 Claims, 17 Drawing Sheets

POWER UNIT FOR A VEHICLE

BACKGROUND OF THE INVENTION

This invention relates to a power unit to be mounted on a vehicle, such as a three- or four-wheel vehicle, particularly to a power unit for a vehicle which is constructed by integrally joining an internal combustion engine and a transmission and adapted for use in a saddle type vehicle for off-road running as, for example, a so called a buggy vehicle.

As shown in FIG. 16 (refer to Japanese Laid-Open Patent Publication SHO 63-137087), most customary saddle type vehicles 01 have a power unit 02 with a crankshaft and transmission shafts directed in the vehicle width direction perpendicular to the running direction of the vehicle.

In the power unit 02 shown in FIG. 16, a case constructed by joining integrally a crankcase and a transmission case has bosses 04,05,06,07 for attachment at a front upper part, a front middle part, a rear upper part and a rear lower part, respectively, and the attachment bosses 04,05,06,07 are detachably attached to a vehicle body frame 08 through brackets 09. Therefore, in case of fitting the power unit 02 to the body frame 08 of the vehicle 01, a jig (not shown) is inserted in the hole of the boss 06 and a hanging piece (not shown) is engaged with a front lower end step portion 011 of a cylinder head 010 to suspend the power unit 02.

Because the saddle type vehicle 01 usually has a body frame 08 extending above the power unit 02, it is impossible to lower the power unit 02 suspended by the jig and hanging piece from above for fitting the power unit to the body frame 08 and, therefore, it is necessary to support the power unit 02 by two kinds of jigs and hanging pieces spaced in the width direction like a cantilever and bring the power unit into the vehicle laterally while moving the power unit in the width direction. Accordingly, the work of fitting the power unit was not easy.

On the other hand, as a power unit to be mounted on the saddle type vehicle with a crankshaft and transmission shafts directed in the vehicle running direction, hitherto, a power unit as described in Japanese Laid-Open Utility Model Publication SHO 63-125139 (ref. FIG. 17) has been known.

In case that the power unit with the crankshaft and transmission shafts directed in the vehicle running direction is fitted in the saddle type vehicle, it is necessary that tip end portions of the above-mentioned jig and hanging piece are bent at right angles; the bent tip end portions are moved in the vehicle running direction and engaged with the attachment bosses to support the power unit like a cantilever; and then the power unit is moved in the vehicle running direction. Therefore, the work of fitting the power unit was more difficult compared with the case of the saddle type vehicle 01 having the crankshaft and transmission shafts directed perpendicularly to the vehicle running direction.

In the power unit shown in FIG. 17, a cylinder block c, a cylinder head d and a head cover e are stacked on a crankcase b, in turn, and integrally connected to each other with a cylinder hole a of the internal combustion engine directed vertically. On the left of a crankshaft f positioned directly below the cylinder hole a is arranged a transmission shaft g; under the transmission shaft g an auxiliary shaft h; and on the right of the auxiliary shaft h and directly under the crankshaft f an output shaft i. Other shafts are arranged so as to surround the crank shaft f.

Further, on the right of the cylinder hole a is arranged a cam shaft j which is connected to the crankshaft through a chain-transmitting mechanism k. A push rod m is interposed between a rocker arm (not shown) and a cam follower l rocking up and down in response to the rotation of the cam shaft j and suction and exhaust valves (not shown) are opened and closed according to intermittent up and down motions of the push rod m.

In the customary power unit for vehicle of FIG. 17, a group of transmission shafts g, h, i are arranged in a region extending from the left to below of the crankshaft f and remaining shafts are arranged in a region extending from below to the right of the crankshaft f, so that the width in the left and right directions and the height of the crankcase b increase so that miniaturization of the power unit is difficult.

In addition, because the push rod-type cam-moving mechanism is arranged on the right of the cylinder hole a, the head portion of the power unit expands toward the right, so that when the power unit is installed in the vehicle, sometimes the power unit approaches too closely the inside of the thigh of the driver sitting astride a seat above the power unit.

SUMMARY OF THE INVENTION

The present invention aims to improve the customary power unit for such vehicles and to overcome the above-mentioned faults. According to the present invention, there is provided a power unit to be mounted in a nearly central portion of a vehicle, having a crankshaft and a plurality of transmission shafts directed in a running direction of the vehicle and supported rotatably within a case which is formed by integrally joining a crankcase of an internal combustion engine and a transmission case wherein: a plurality of the transmission shafts are arranged on one side of the crankshaft and a cam shaft is rotatably supported at a position on the other side of, and adjacent to, the crankshaft; a cylinder block and a cylinder head housing a cam-moving device are inclined at an upper part of the crankcase from the side of the crankshaft to the side of the transmission shafts; the cylinder head is provided with a ignition plug on one side with respect to a cylinder axis and the cam moving device on other side; and the cam moving device is arranged directly over the crankshaft.

In the power unit of the above invention, since a plurality of the transmission shafts are arranged on one side of the crankshaft and a cam shaft is rotatably supported at a position on the other side of and adjacent to the crankshaft, it is possible to lower the height of the case without broadening the width in the left and right direction thereof and to thereby miniaturize the power unit.

Further, since a cylinder block and a cylinder head housing a cam-moving device are inclined at an upper part of the crankcase from the side thereof containing the crankshaft to the side thereof containing the transmission shafts, the cylinder head is provided with a ignition plug on one side with respect to a cylinder axis and the cam-moving device on the other side thereof, and the cam-moving device is arranged directly over the crankshaft, the transverse shape of the power unit can be nearly that of an isosceles triangle so that in the state the power unit is mounted on the vehicle, the driver can sit astride a seat positioned over the power unit easily with a natural attitude for driving, the center of gravity of the power unit can be lowered, and the ignition plug provided on the inclined cylinder can be changed easily without being obstructed by a seat and an overlying fuel tank.

Also, in a power unit for a vehicle according to the invention, bosses for attachment are provided on both sides of a lower part of the case, and an engaging recess directed laterally toward a center part of the case and having a tip end portion directed upwardly along the case is formed on each side of an upper part of the case.

This power unit for a vehicle can be installed in the vehicle very easily in such a manner that, after an engaging projection of a supporting jig is engaged with the engaging recess of the power unit, a lower part of the supporting jig below the engaging projection and the boss for attachment of the power unit are connected integrally with each other, and the power unit thus supported like a cantilever by the supporting jig is brought into the vehicle body laterally.

Also, since the boss for attachment is provided only on both sides of a lower part of the case and not on an upper part, when the power unit is mounted on a saddle type vehicle, no boss approaches the inside of the thigh of the driver sitting astride a seat above the power unit.

DETAILED DESCRIPTION OF THE PREFERRED EMBODIMENT

Hereinafter, a preferred embodiment of the present invention will be described with reference to FIGS. 1 to 15.

Figure 1:
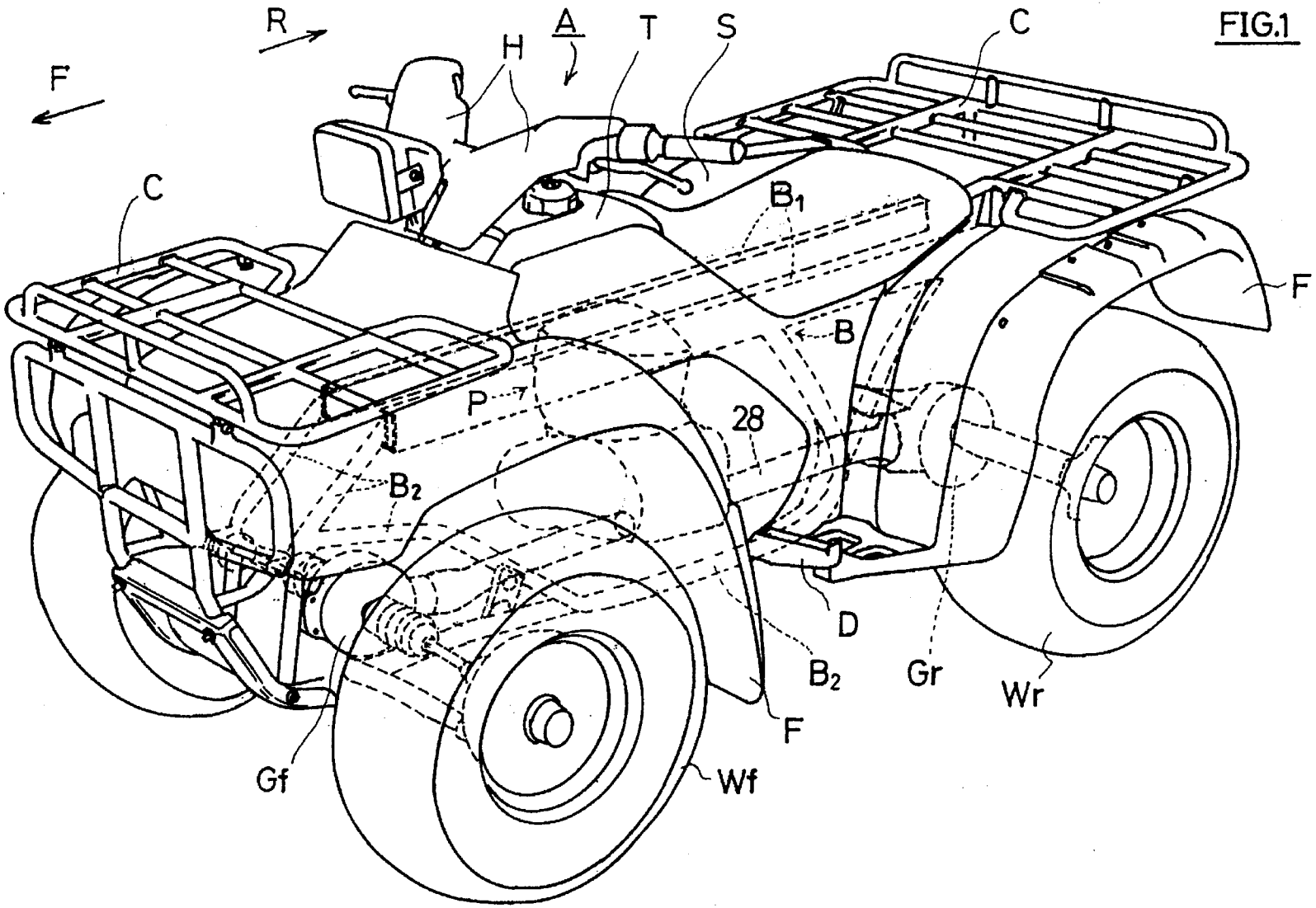
FIG. 1 is a schematic perspective view of a saddle type vehicle for off-road running having a power unit for a vehicle according to the present invention.

FIG. 1 shows a saddle type vehicle for off-road running A which is called a buggy vehicle. In the vehicle A, a pair of left and right channel-shape main frames $B_1$ extend in the fore and aft direction at an upper portion of the vehicle body, pipe-shape frames $B_2$ are provided integrally below the main frames $B_1$ and at front and rear portions of a body frame B composed of the channel-shape main frames $B_1$, and the pipe-shape frames $B_2$ are provided between the left and right front wheels Wf and rear wheels Wr, respectively. These driving wheels Wf, Wr are fitted with balloon-type low pressure tires.

On the upper part of the vehicle A are arranged a steering handle H, a fuel tank T and a seat S, in turn, from front to rear. A power unit P for driving the front wheels Wf and rear wheels Wr is mounted beneath the fuel tank T and the seat S in a central part of the body frame B.

The vehicle A has fenders F covering the front and rear wheels Wf, Wr from above and carriers C positioned on the upper surfaces of the fenders F.

Steps D for supporting the feet of a driver sitting astride the seat S are provided at lower portions of a middle part of the body frame B. A brake pedal (not shown) is arranged near the right side step D and a change pedal (not shown) near the left step D.

Figure 2:
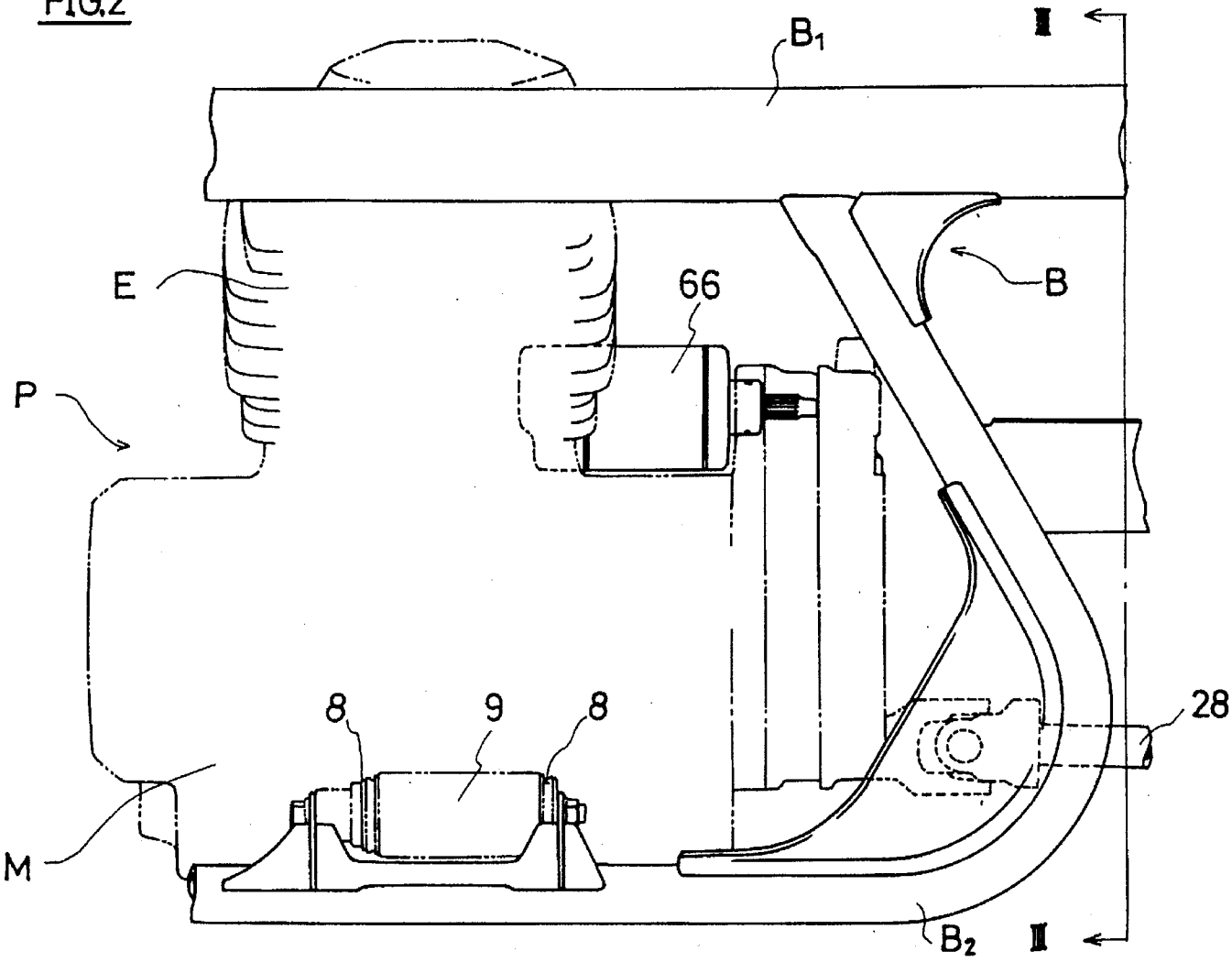
FIG. 2 is an enlarged side view of an essential part of FIG. 1.
Figure 3:
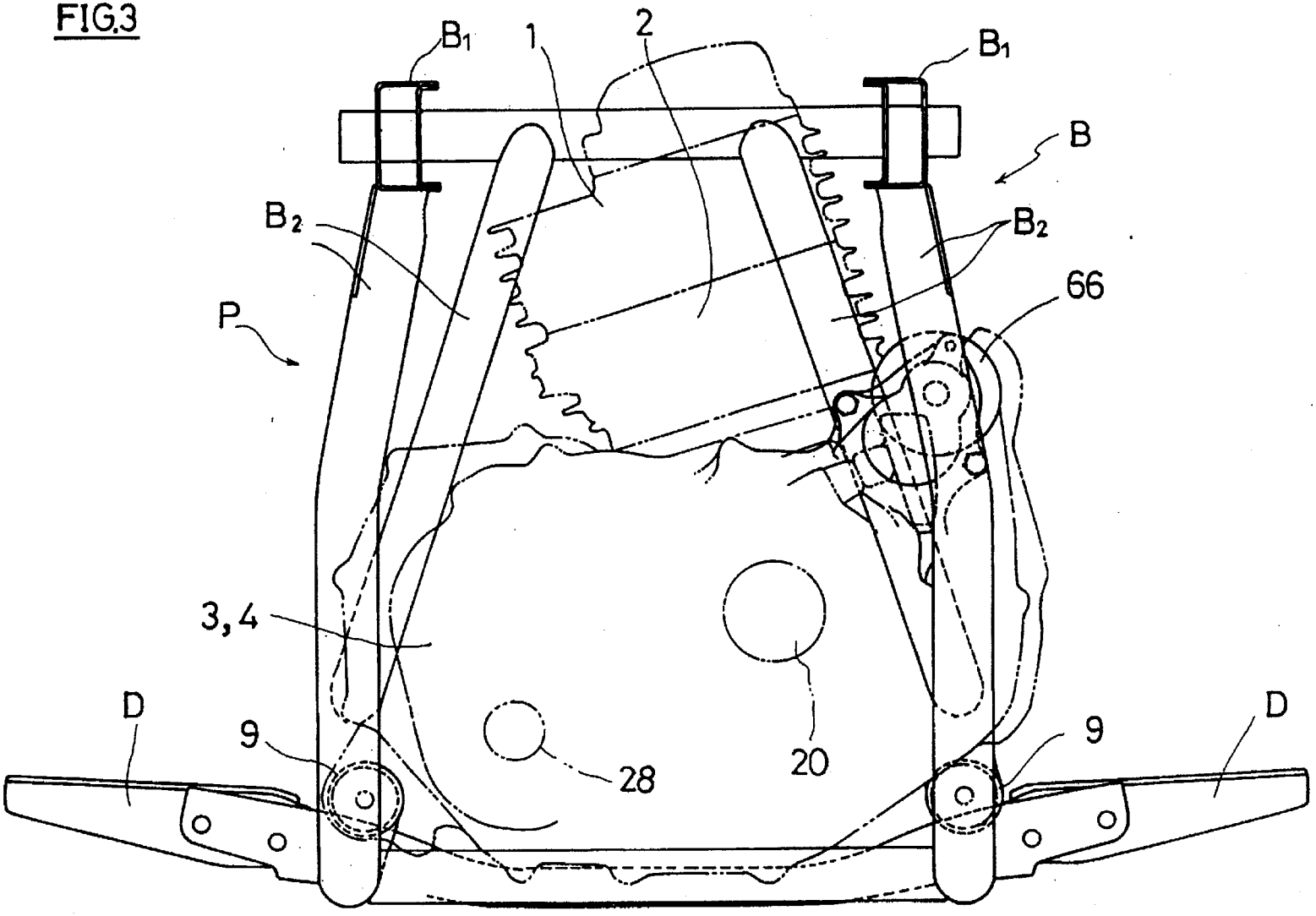
FIG. 3 is a view of the same part viewed in the direction of arrows III—III of FIG. 2.

The power unit P is constructed by assembling a crankcase of an internal combustion engine E and a case of a transmission M in one body. The internal combustion engine E is divided into a cylinder head 1, a cylinder block 2, a front crankcase 3, a rear crankcase 4, a front case cover 5 and a rear case cover 6. The front crankcase 3 and the rear crankcase 4 are joined integrally with each other and connected to the left and right pipe-shape frames $B_2$ at bosses 8 provided on both sides of the lower portion through elastic mount elements 9 (ref. FIGS. 2, 3).

As shown in FIGS. 6 to 9, the cylinder block 2 is placed on the front and rear crankcases 3, 4, which are connected integrally with each other, and cylinder-case connecting bolts 11 are inserted, screwed and fastened in two bolt holes 10 provided in the cylinder block 2 and the front and rear crankcases 3, 4. On the cylinder block 2 are placed the cylinder head 1 and a rocker arm holder 19, and a holder-head-cylinder connecting bolt 13 is inserted, screwed and fastened in a bolt hole 12 provided in the rocker arm holder 19, cylinder head 1 and cylinder block 2. A head-cylinder connecting bolt 15 is inserted, screwed and fastened in a bolt hole 14 provided in the cylinder head 1 and cylinder block 2. Further, head-cylinder-case connecting bolts 17 are inserted, screwed and fastened in two bolt holes 16 provided through the cylinder head 1, cylinder block 2 and front and rear crankcases 3, 4. And then a connecting bolt (not shown) is inserted, screwed and fastened in a bolt hole 18 provided through the rocker arm holder 19, cylinder head 1, cylinder block 2 and front and rear crankcases 3, 4. Thus, the cylinder head 1, cylinder block 2, front crankcase 3, rear crankcase 4 and rocker arm holder 19 are connected integrally.

Figure 5:
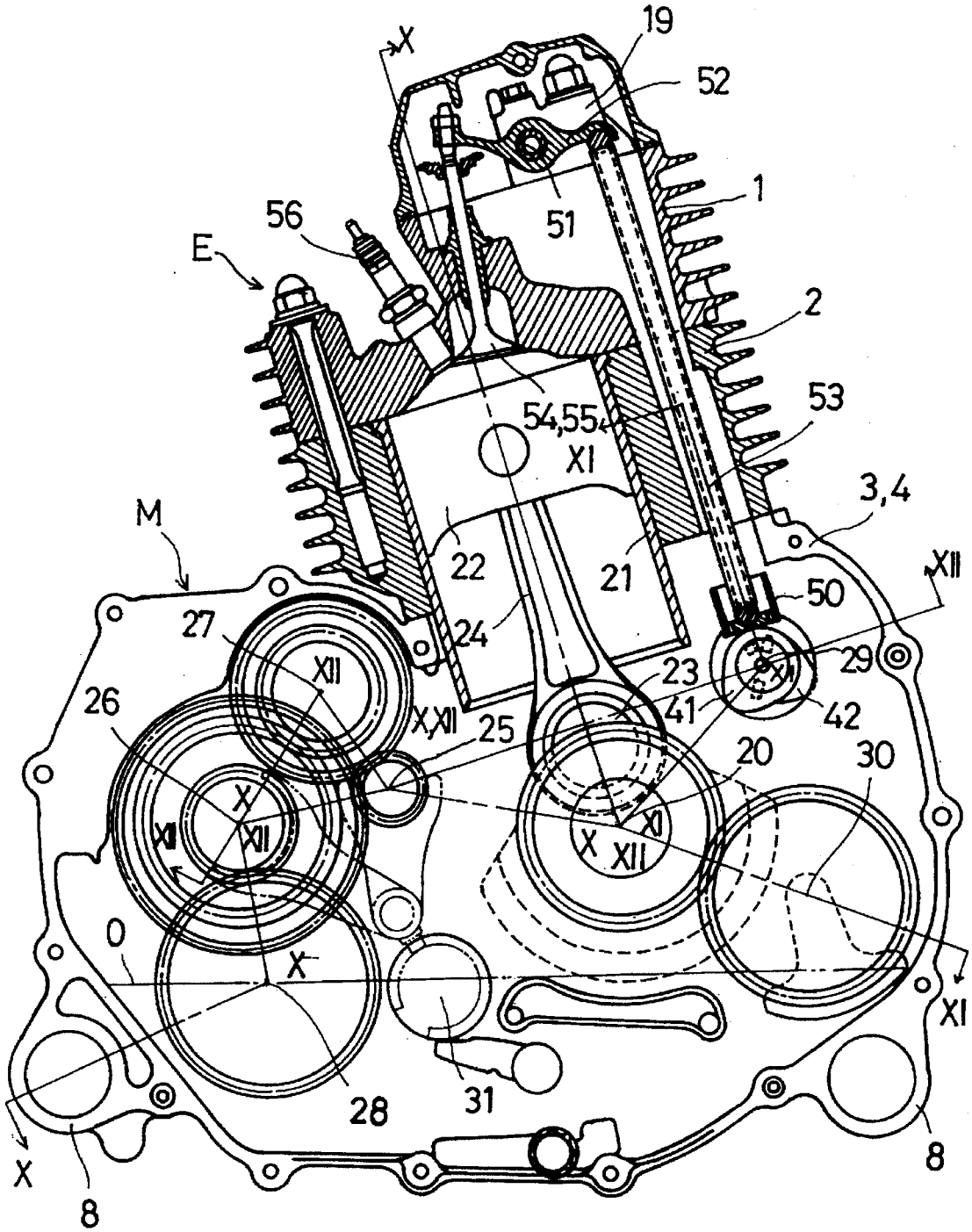
FIG. 5 is a partially sectioned rear view in which the rear case cover is removed and the cylinder head and cylinder block are sectioned along center line.
Figure 6:
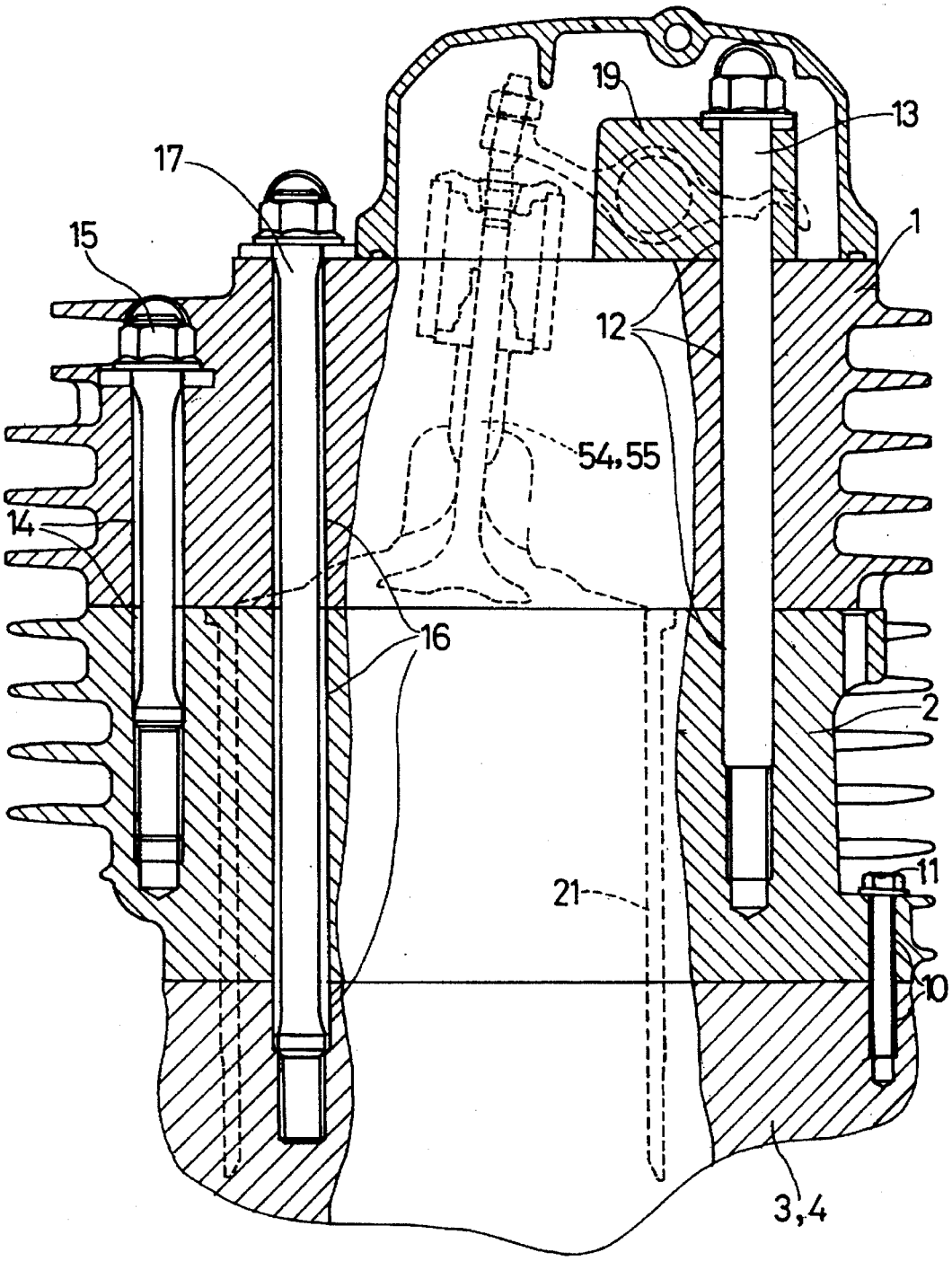
FIG. 6 is a sectional view along the line VI—VI of FIG. 7.
Figure 7:
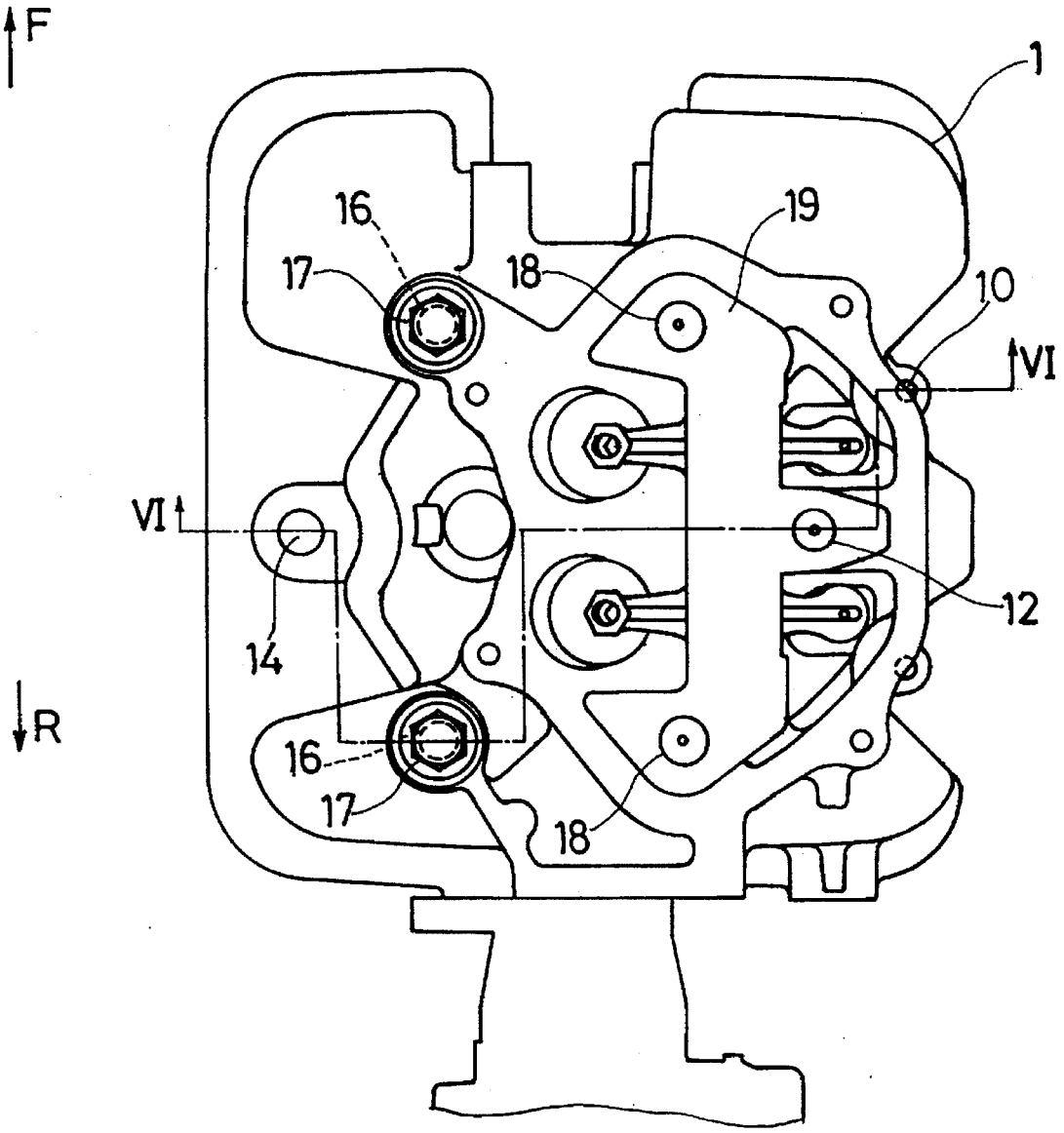
FIG. 7 is a plan view of the cylinder head.
Figure 8:
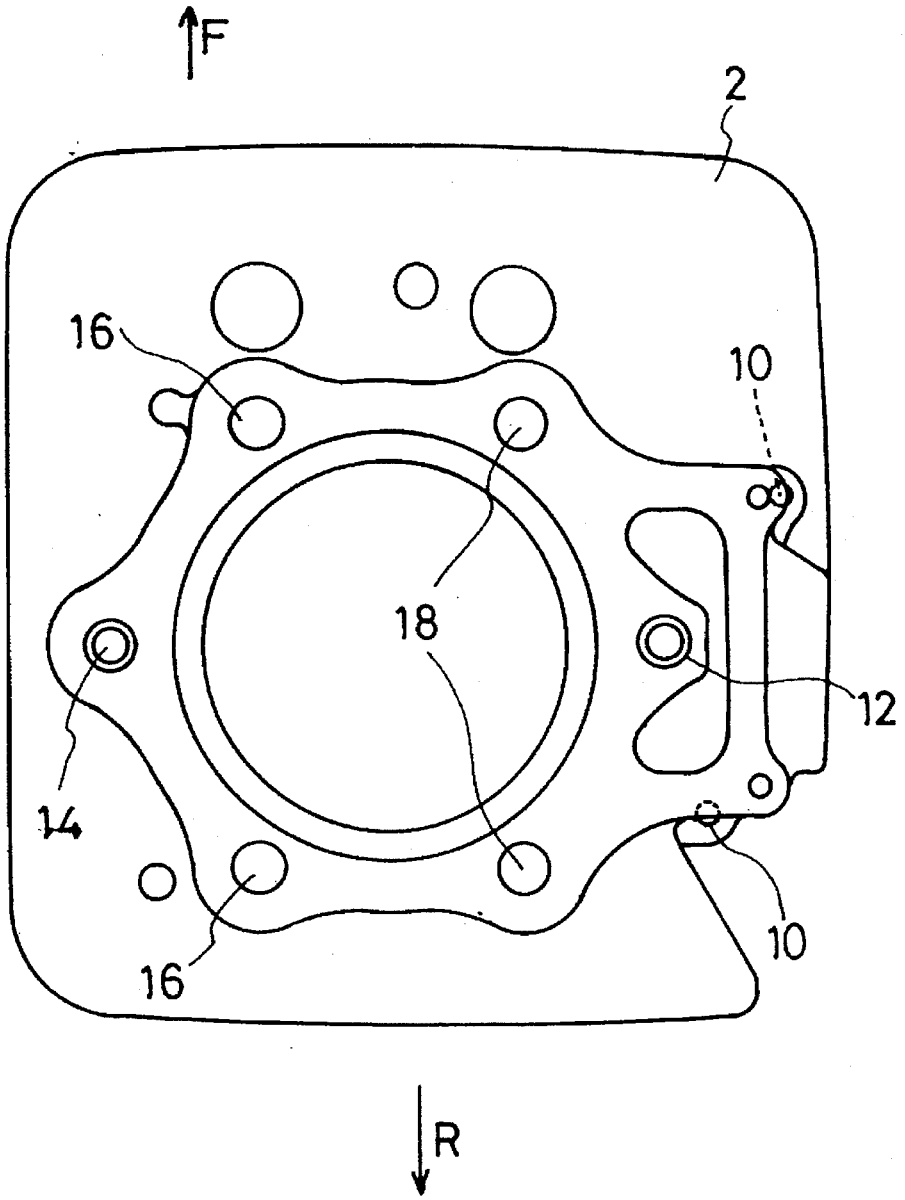
FIG. 8 is a plan view of the cylinder block.
Figure 9:
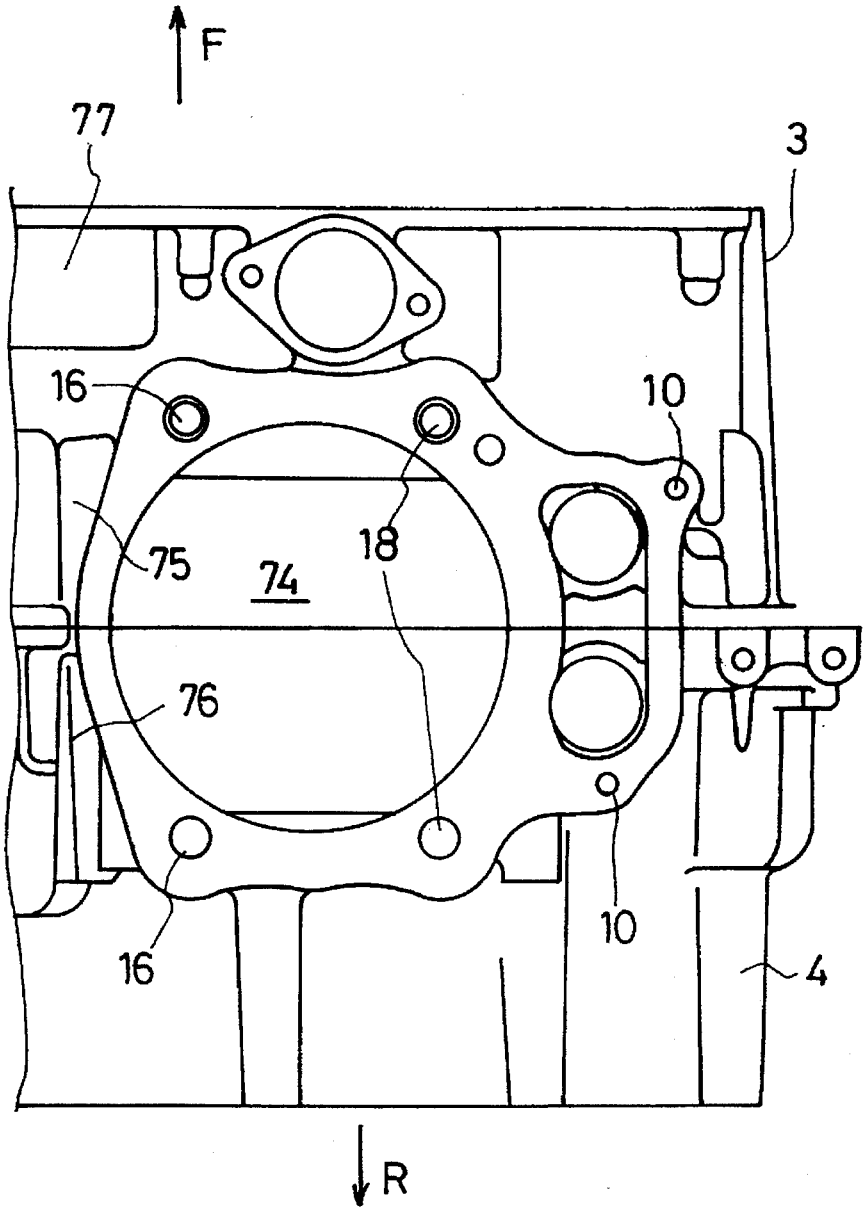
FIG. 9 is a plan view of an essential part of the front crankcase and rear crankcase.

As shown in FIG. 5, a crankshaft 20 rotatably supported by the front crankcase 3 and the rear crankcase 4 of the internal combustion engine E is directed in the running direction of the vehicle A, and is displaced slightly toward right side from the center of the front and rear crankcases 3, 4. The cylinder block 2 and the cylinder head 1 are inclined to the left so as to be directed obliquely left and above from the crankshaft 20. A piston 22 slidably fitted in a cylinder 21 is connected to a crankpin 23 of the crankshaft 20 through a connecting rod 24 so that the crankshaft 20 is rotationally driven by up-and-down motion of the piston 22.

A main shaft 25 and an auxiliary shaft 26 are arranged, in turn, on the left of the crankshaft 20; a reverse shaft 27 is arranged in an upper portion between the main shaft 25 and the auxiliary shaft 26 and a propeller shaft 28 is arranged under the auxiliary shaft 26. These shafts 25, 26, 27 and 28 are parallel with the crankshaft 20 and rotatably supported by the front and rear crankcases 3, 4.

In a position obliquely right and above the crankshaft 20 is arranged a cam shaft 29 and under the cam shaft 29 a balancer shaft 30. Further, positioned under the main shaft 25 and on the right of the propeller shaft 28, a shift drum 31 is arranged. The cam shaft 29, the balancer shaft 30 and the shift drum 31 are rotatably supported by the front and rear crankcases 3, 4.

Figure 4:
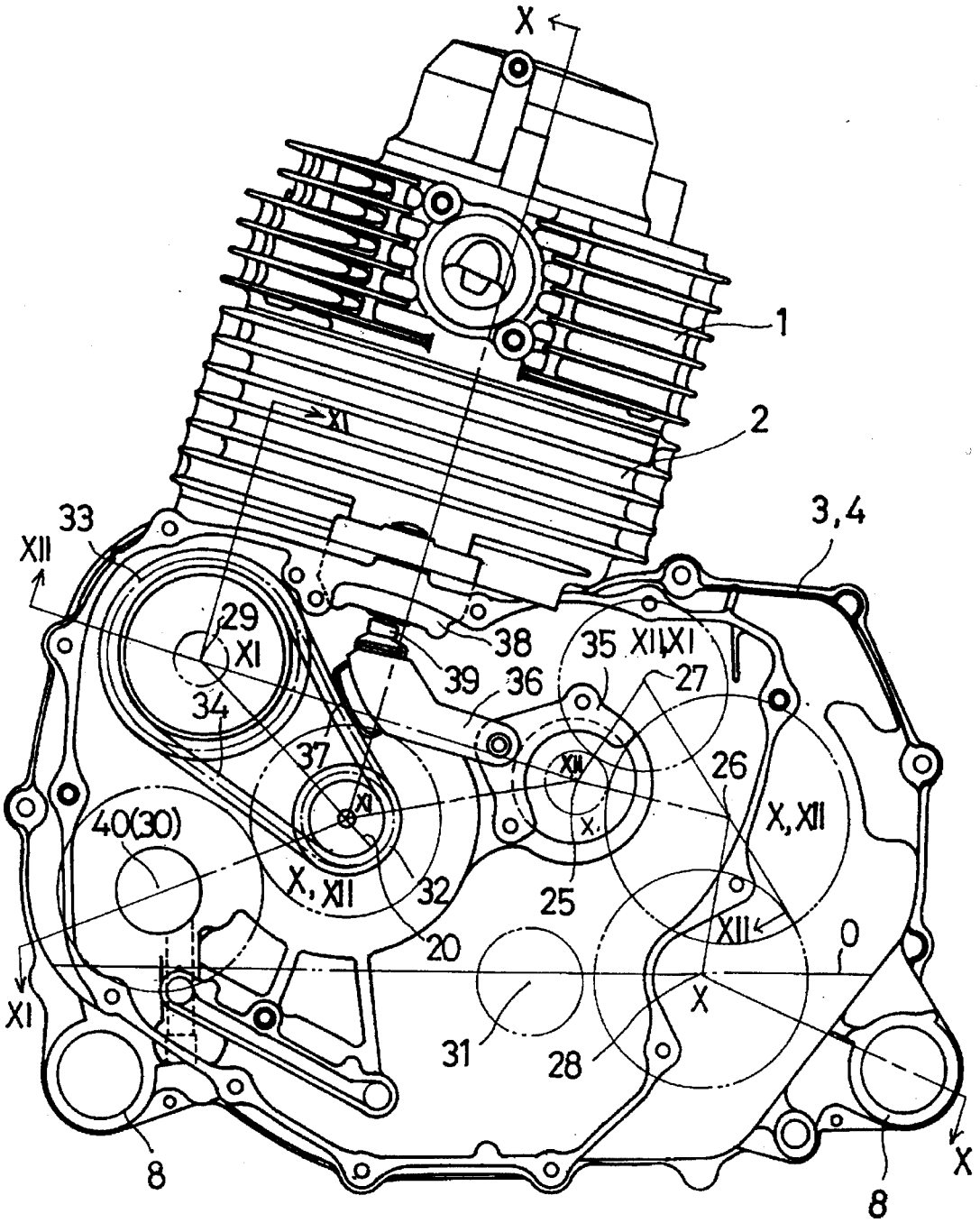
FIG. 4 is a front view of the power unit in the state that the front case cover is removed.

As shown in FIG. 4, the crankshaft 20 and the cam shaft 29 are provided with sprockets 32, 33, respectively, and an endless chain 34 is wound around the sprockets 32, 33 so that the cam shaft 29 is rotated by the crankshaft 20 at a half speed.

Figure 12:
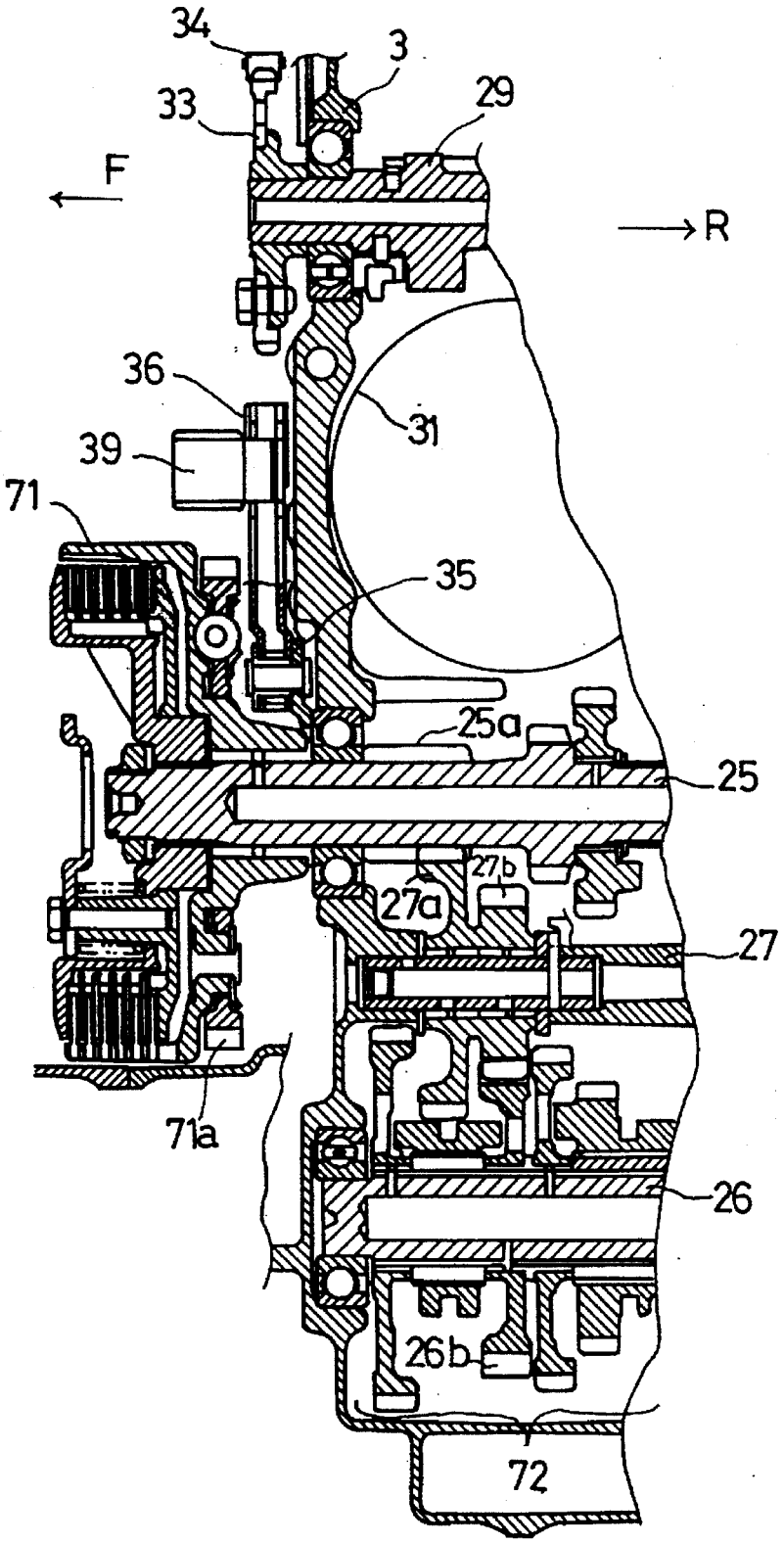
FIG. 12 is a sectional view of the power unit along the line XII—XII of FIG. 4.

The sprockets 32, 33 are arranged at a position forwardly projected from the front crankcase 3. A chain tensioner 36 is provided on a bearing holder of the main shaft 25 swingably up and down. A slipper 37 is provided on an undersurface at a tip end of the chain tensioner 36. An adjusting apparatus 38 is fitted in the front crankcase 3 from above and fixed by a bolt (not shown). A pressing part of the adjusting apparatus 38 is abutted against a receiving part 39 which projects forward from the chain tensioner 36 as shown in FIG. 12. The chain tensioner 36 is energized by the force applied from the pressing part of the adjusting apparatus 38 to set the endless chain 34 in a moderate strained state by means of the slipper 37.

Figure 11:
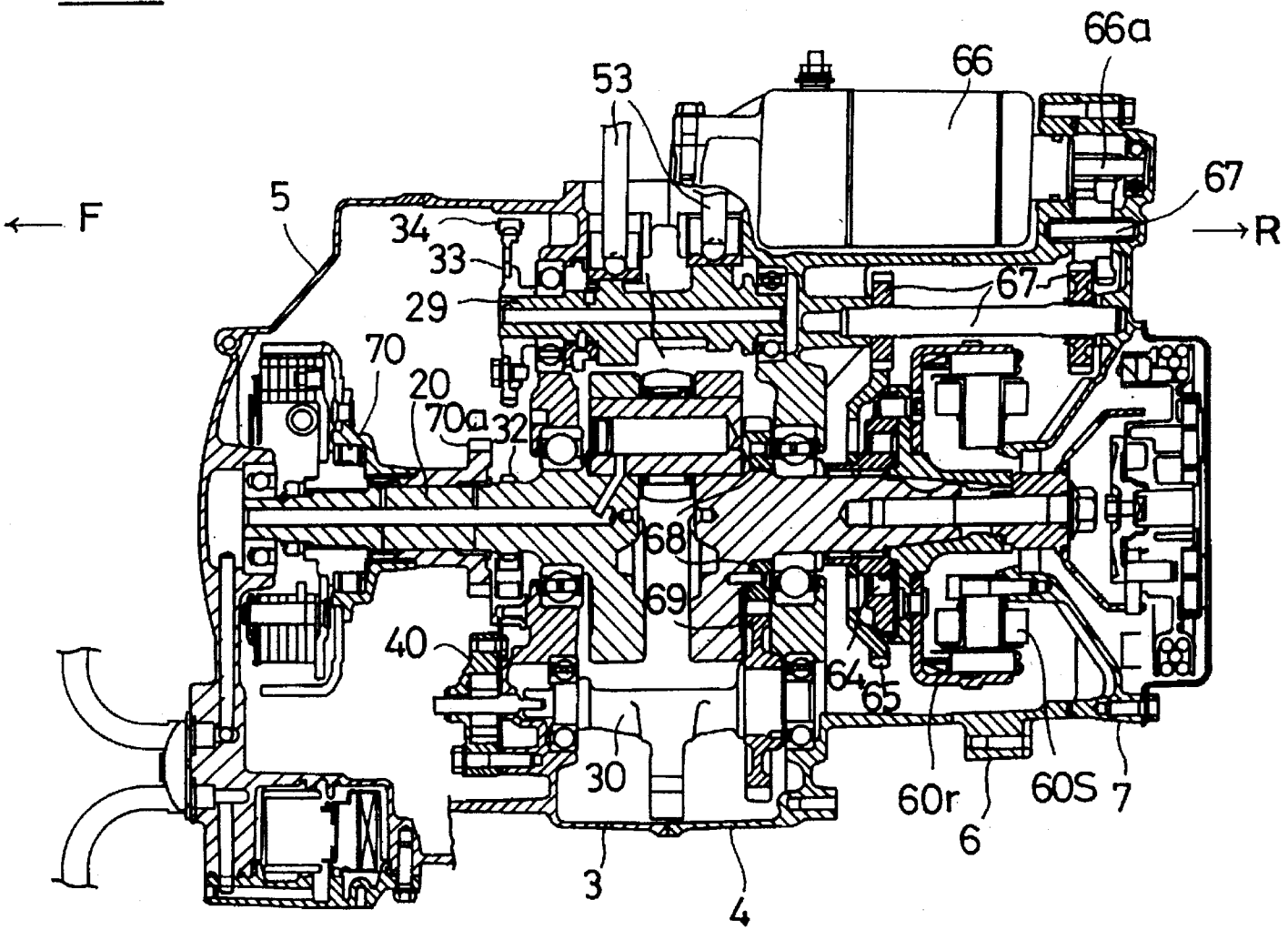
FIG. 11 is a sectional view of the power unit along the line XI—XI of FIG. 5.

As shown in FIG. 11, in front of the balancer shaft 30 is arranged an oil pressure pump 40 with a rotary shaft directly connected to the balancer shaft 30 so that when the engine E is operated the oil pressure pump 40 is rotationally driven together with the balancer shaft 30 for supplying oil to lubrication parts of the engine E and the transmission M.

Figure 13:
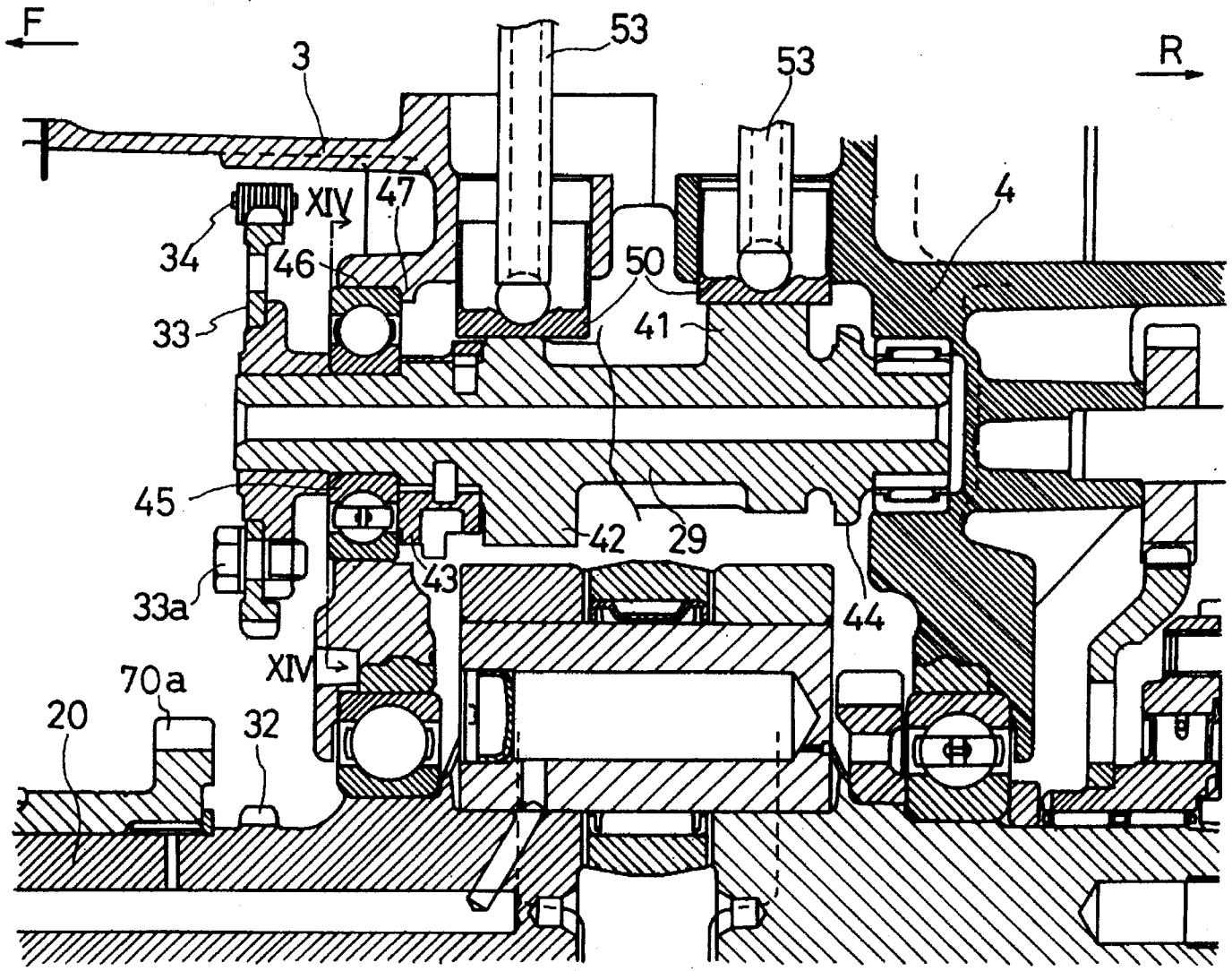
FIG. 13 is an enlarged sectional view of an essential part of FIG. 11.
Figure 14:
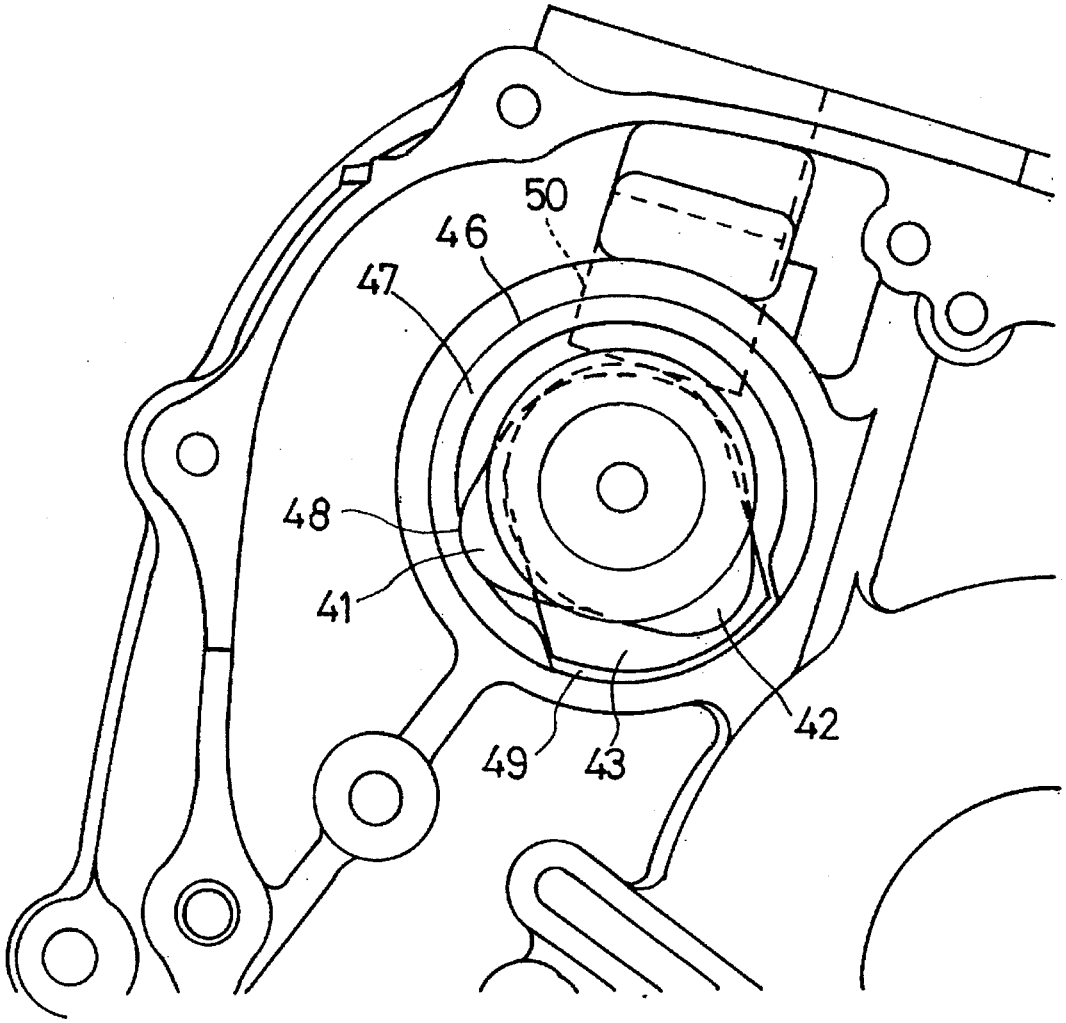
FIG. 14 is a view viewed in the direction of arrows XIV—XIV of FIG. 13.

As shown in FIGS. 11 and 13, the cam shaft 29 is integrally formed with a suction cam 41 and an exhaust cam 42 and has a decompression cam 43 in front of the exhaust cam 42 and a rib 44 behind the suction cam 41. The front crankcase 3 is provided with a cylindrical surface portion 46 having a diameter the same as that of an outer peripheral surface of a ball bearing assembly 45 supporting a front portion of the cam shaft 29 and larger than that of the base circle of the cam shaft 29. Behind the cylindrical surface portion 46 is formed a stopper step portion 47. The stopper step portion 47 has recesses 48, 49 so that the cam shaft can be drawn out when the suction cam 41, exhaust cam 42 and decompression cam 43 are brought to the positional relation, as shown in FIG. 14.

Tappets 50 are fitted to the front and rear crankcases 3, 4 movably up and down at positions above the suction cam 41 and the exhaust cam 42. Between the tappet 50 and a right end of a rocker arm 52, which is swingably supported on the rocker arm holder 19 through a rocker shaft 51, as shown in FIG. 5, is interposed a push rod 53. The rocker arm 52 is swung up and down in response to rotation of the cam shaft 29 for opening and closing a suction valve 54 or an exhaust valve 55 which is positioned on the right of the center of the cylinder 21 and abutted against the left end of the rocker arm 52.

An ignition plug 56 is positioned on the left of the center line of the cylinder 21 and is inclined further to the left side with respect to the center line.

To a suction passage 57 provided with the suction valve 54 is connected a carburetor 59, and to an exhaust passage 58 provided with the exhaust valve 55 is an exhaust pipe (not shown).

Figure 10:
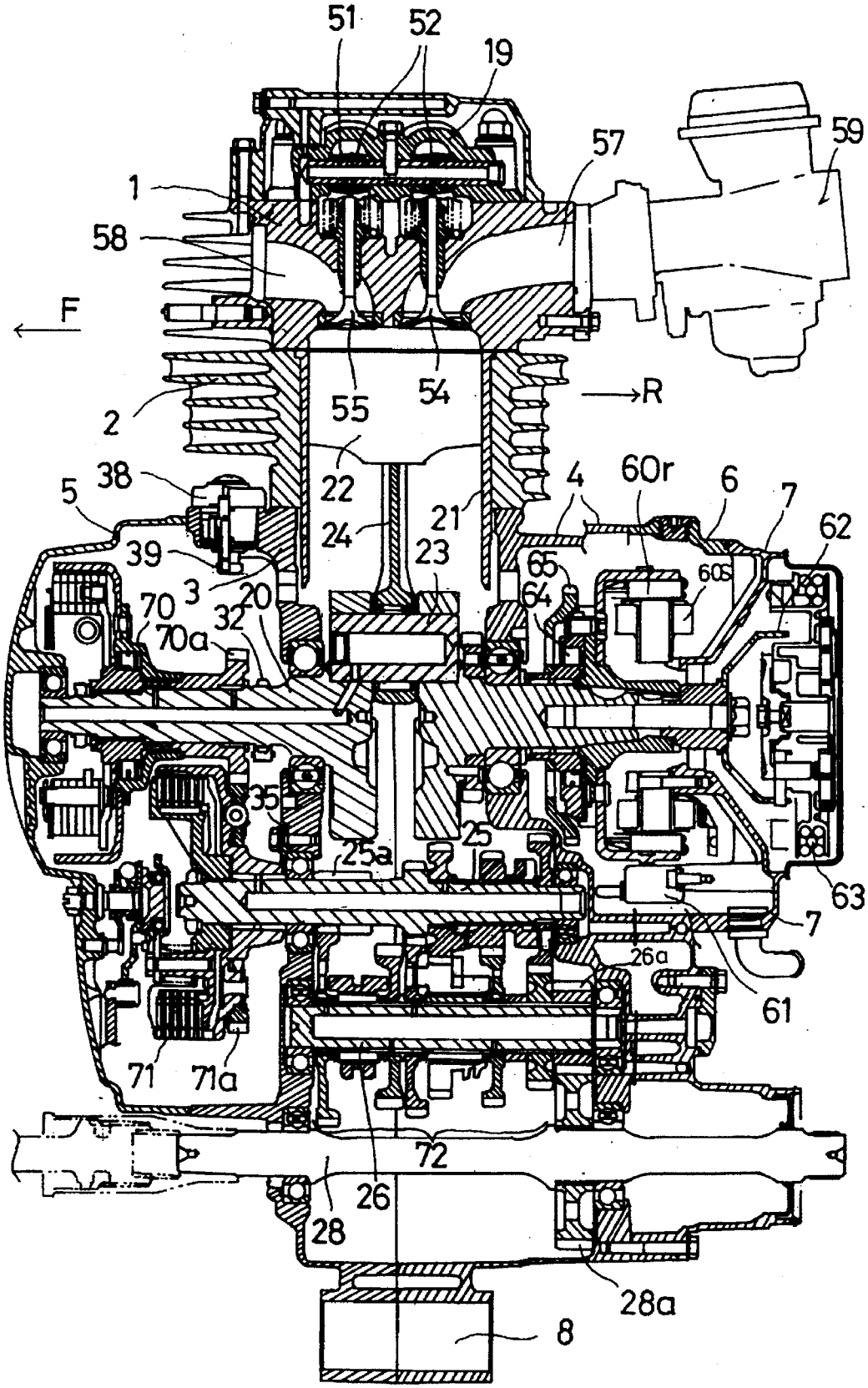
FIG. 10 is a sectional view of the power unit along the line X—X of FIG. 4.

On a rear portion of the crankshaft 20 is provided a rotor **60*r* of an ACG 60. An ACG cover 7 is detachably attached to the rear case cover 6 which is attached to the rear crankcase 4, and a stator 60*s* of the ACG 60 is attached to the ACG cover 7. As shown in FIG. 10, the ACG cover 7 is attached with the ACG 60 and other electric parts and by removing the ACG cover 7, the stator 60*s* of the ACG 60, pulser 61, and other electric parts, can be taken out all at once together with the ACG 7**.

A starting wheel 62 is fitted to the rear end of the crankshaft 20 and a recoil starter 63 is arranged opposite to the starting wheel 62. The internal combustion engine E can be started by manually handling the recoil starter 63.

As shown in FIG. 11, in front of the rotor **60*r* of the ACG 60, a starting gear 65 is loosely fitted on the crankshaft 20 through an one-way clutch 64. The starting gear 65 is connected to an output shaft 66*a* of a starter motor 66 attached to the rear crankcase 4 through a reduction gear device 67. Rotation of the starter motor 66 is transmitted to the crankshaft through the reduction gear device 67, the starting gear 65 and the one-way clutch 64** for starting the internal combustion engine E automatically.

To the front end of the crankshaft 20 is attached a centrifugal type starting clutch 70; to the front end of the main shaft 25 is attached a multi-plate type change clutch 71; and an output gear **70*a* of the centrifugal type starting clutch 70 is meshed with an input gear 71*a* of the multi-plate type change clutch 71. When the crankshaft 20 stops or rotates at a rotational speed below a predetermined speed, the centrifugal type starting clutch 70 is in a cut-off state, and when the rotational speed of the crankshaft 20 exceeds the predetermined speed, the centrifugal type starting clutch 70** assumes a connecting state.

As shown in FIG. 10, multi-step change gear trains 72 are interposed between the main shaft 25 and the auxiliary shaft 26. An output gear **26*a* of the auxiliary shaft 26 is engaged with an input gear 28*a* of the driving shaft 28; an output gear 25*a* of the main shaft 25 is engaged with an input gear 27*a* of the reverse shaft 27 (FIG. 12); and an output gear 27*b* of the reverse shaft 27 is engaged with a reverse input gear 26*b* of the auxiliary shaft 26. When a change pedal near the left step D is manipulated to a changing position, or a reverse position as required, only when the pedal is manipulated, the multi-plate type changing clutch 71 is cut off and the multi-step changing gear train 72 and the reverse input gear 26*b* of the auxiliary shaft 26 are changed, and the auxiliary shaft 26** is set to the required speed change ratio or normal-reverse state to be rotationally driven.

Figure 15:
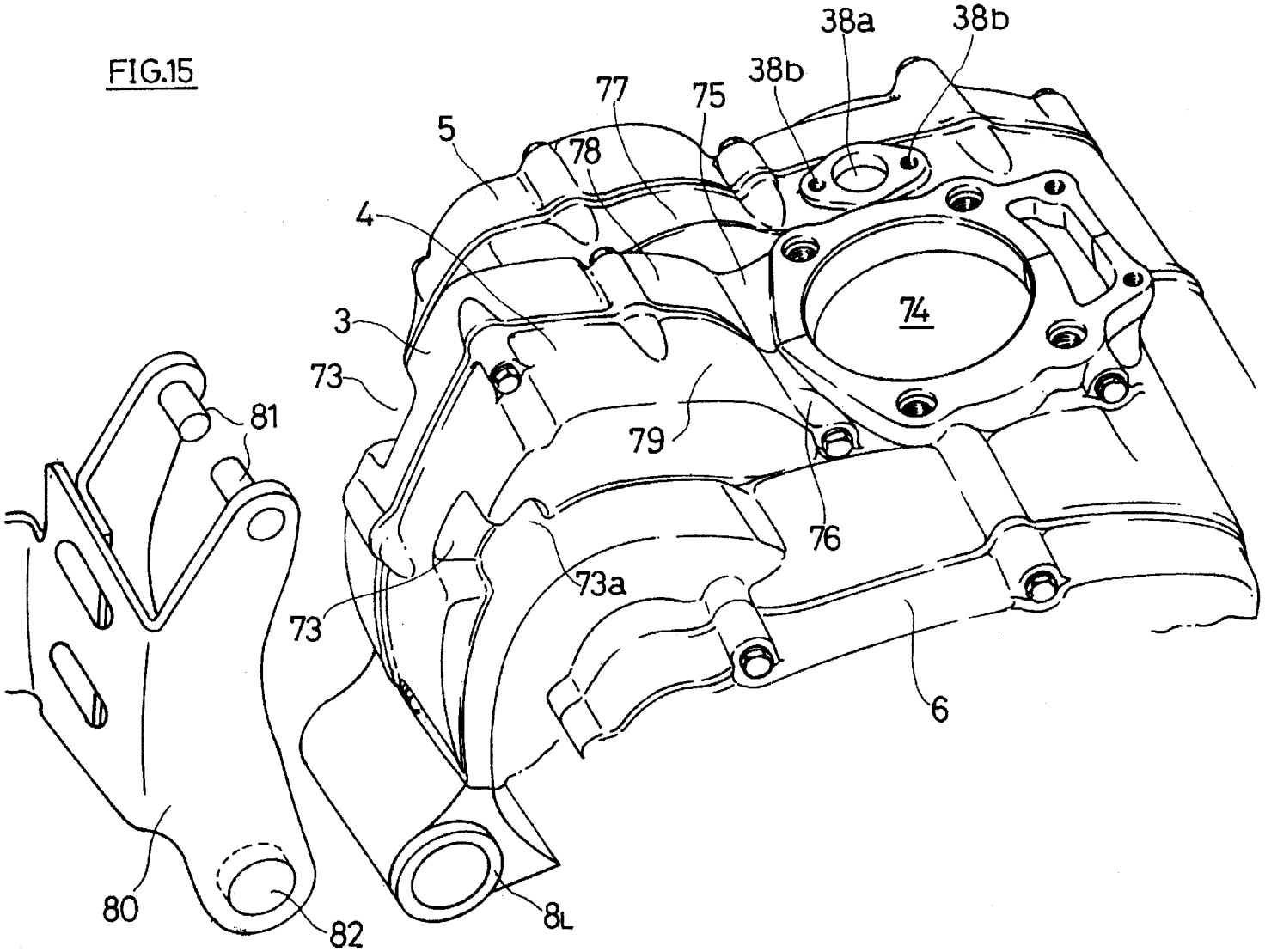
FIG. 15 is a perspective view of the front and rear crankcases viewed from an obliquely left, rear and upper position.
Figure 16:
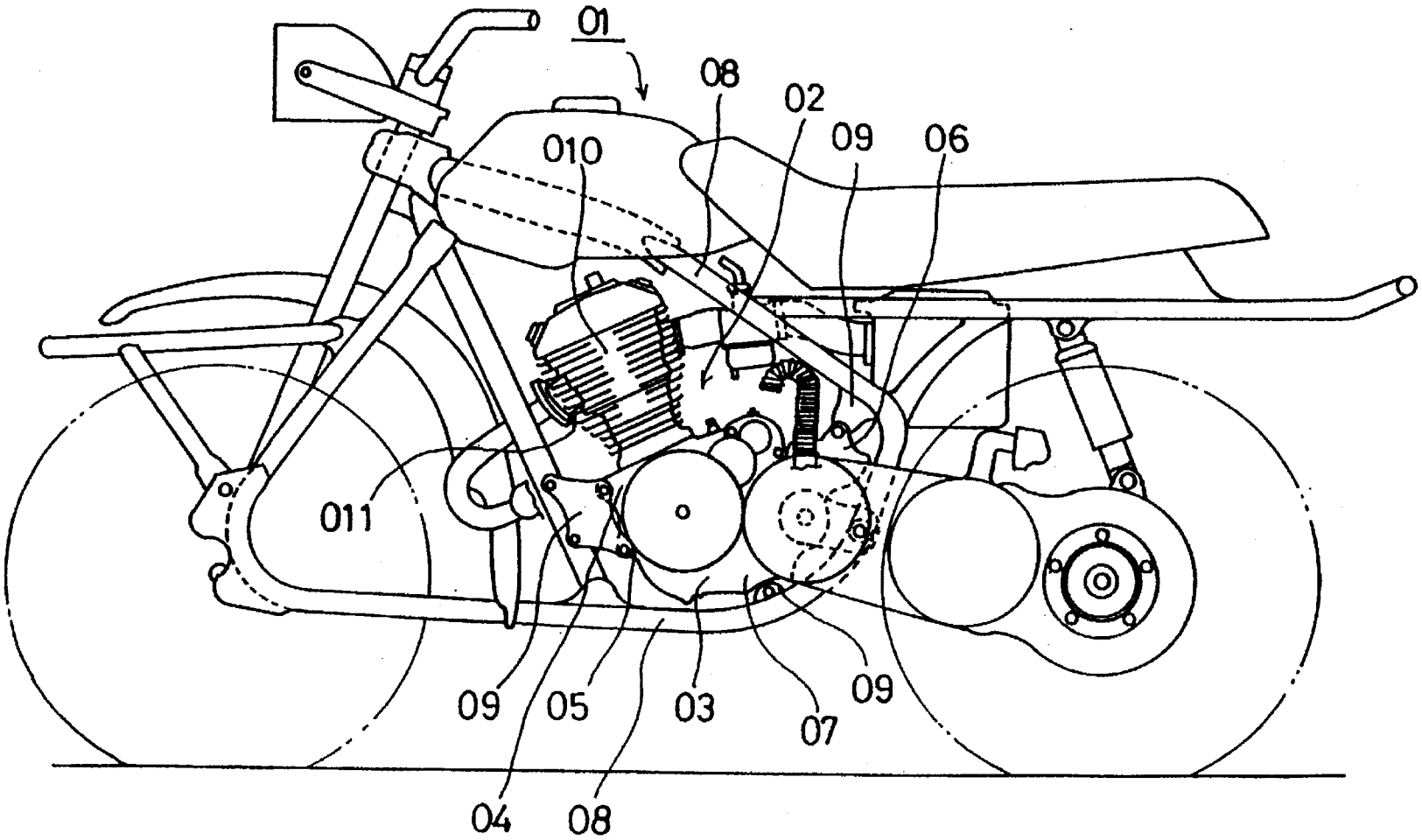
FIG. 16 PRIOR ART
FIG. 16 is a side view of a conventional vehicle.
Figure 17:
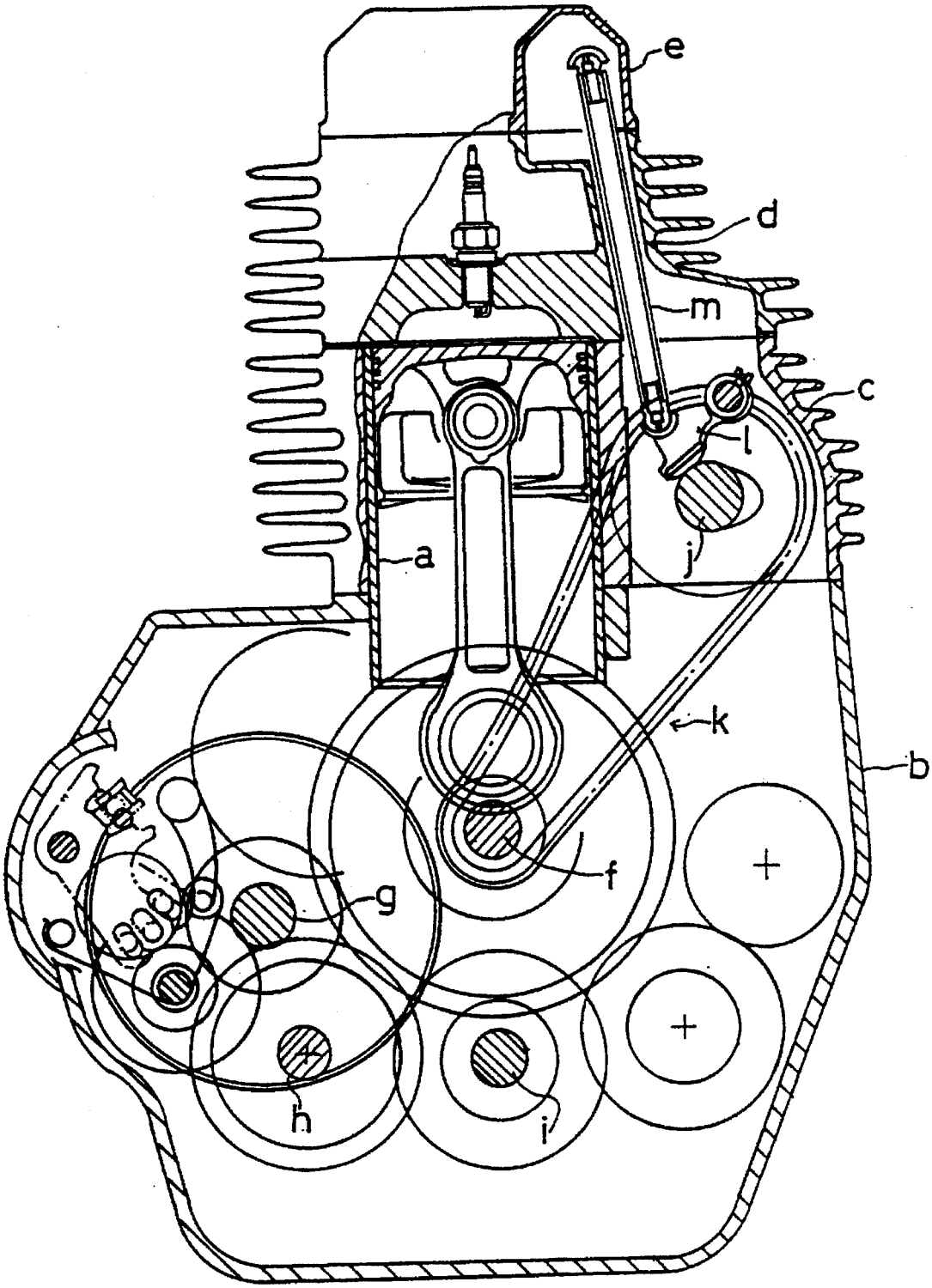
FIG. 17 PRIOR ART
FIG. 17 is a longitudinal section view of a conventional power unit for a vehicle.

As shown in FIG. 15, on each left upper portion of the front crankcase 3 and the rear crankcase 4 is formed an engaging recess 73 extending toward the center and top of the case and having a tip end part **73*a*** directed upward.

The front crankcase 3 and the rear crankcase 4 have case upper surface portions 75, 76, respectively, at the left side of a cylindrical opening 74 and a clutch upper portion 77 in front of and adjacent to, the case upper surface portion 75 is swelled upward due to the presence inside of the ACG 60. Transmission upper portions 78, 79 at the left side of the case upper surface portions 75, 76 are also swelled upward and the case upper surface portions 75, 76 surrounded by the clutch upper portion 77 and the transmission upper portions 78, 79 are slanted gently downward from the position near the clutch upper portion 77 toward behind.

On the upper surface of the front crankcase 3 adjacent to the cylindrical opening 74 is provided an opening **38*a* through which the above-mentioned adjusting apparatus 38 for the tensioner 36 is inserted into the front crankcase 3. 38*b*, 38*b* are bolt holes for fixing the adjusting apparatus to the crankcase 3**.

According to the above-described preferred embodiment, a driver sitting astride the seat S with his feet put on the step D starts the internal combustion engine E by means of the starter motor 66 or recoil starter 63, grips the right grip of the steering handle H, and operates an operation lever (not shown) arranged beneath the grip, whereupon the carburetor is opened and the engine E is accelerated and the centrifugal type starting clutch 70 is connected automatically when the rotational speed of the crankshaft 20 exceeds the predetermined speed, thus the saddle type vehicle for off-road running A can start running.

Since the crankshaft 20, the main shaft 25, the auxiliary shaft 26, the reverse shaft 27 and the driving shaft 28 are all directed in the running direction of the saddle type vehicle for off-road running A, the number of bevel gear devices can be minimized, the power of the internal combustion engine E can be transmitted to the front wheel differential device Gf and the rear wheel driving gear device Gr, and the weight of the power transmitting system can be reduced.

As for the power unit P, since the portion above the crankshaft 20 is inclined to the left, the portion under the crankshaft 20 is arranged to be biased slightly toward the right side from the center of the front and rear crankcases 3, 4. In the left side of the crankshaft 20 are arranged the main shaft 25, the auxiliary shaft 26, the reverse shaft 27, the driving shaft 28 and the shift drum 31 of the transmission M, and in the right side of the crankshaft 20 are arranged the cam shaft 29, the balancer shaft 30, the oil pressure pump 40, the starter motor 66, the cam moving tappet 50, the rocker shaft 51, the rocker arm 52 and the push rod 53. The height of the front and rear crankcases 3, 4 can be made low to achieve miniaturization of the power unit P while keeping the right-left width of the front and rear crankcases 3, 4 narrow. Further, the center of gravity of the power unit P can be lowered by forming the front shape of the power unit P nearly as an isosceles triangle. In addition, the driver can sit astride the seat S above the power unit P easily because the power unit does not approach the inside of his thigh.

The cylinder 21 is inclined to the left and the ignition plug 56 is positioned on the left of the center line of the cylinder 21 and further inclined to the left. Therefore, the ignition plug 56 can be changed easily without interfering with the fuel tank T and the seat S positioned over the cylinder 21.

Since the cylinder 21 is inclined to the left; the cam shaft 29 is arranged on the right and upper side of the crankshaft 20; and the push rod 53 is arranged on the right of the cylinder 21, the dimension in the direction of the crankshaft of the internal combustion engine E can be shortened, as compared with an engine having a push rod positioned over a crankshaft, so that the overall length of the power unit P in the fore and aft direction can be shortened. In addition, the weight of the reciprocating parts of the valve moving system can be reduced by shortening the length of the push rod 53.

Since the balancer shaft 30 is positioned under the cam shaft 29 and the oil pressure pump 40 is arranged over the axis of the balancer shaft 30, the height of the oil pressure pump 40 relative to a lubricant oil surface O within the power unit P can be lowered to reduce suction height of the oil pressure pump 40 for enabling a smooth lubricant suction.

Since the cylinder head 1, the cylinder block 2, the front crankcase 3, the rear crankcase 4 and the rocker arm holder 19 are connected in such manner, as shown in FIGS. 6 to 9, these members 1, 2, 3, 4 and 19 can be firmly joined in one body. Moreover, the cylinder head 1, the cylinder block 2 and the rocker arm holder 19 connected to each other can be easily removed from the front crankcase 3 and the rear crankcase 4, simply by unfastening the cylinder case-connecting bolt 11, the head-cylinder case-connecting bolt 17 and the bolt (not shown) screwed and fastened in the bolt hole 18.

When the cam shaft 29 is intended to be changed, the cylinder head 1 and the cylinder block 2 are removed from the front and rear crankcases 3, 4 and a bolt **33*a* connecting the sprocket 33 to the cam shaft 29 (FIG. 13) is pulled out for removing the sprocket 33 from the cam shaft 29. Then, after the tappets 50 are pulled out upward from the front and rear crankcases 3, 4, the suction cam 41 is positioned in alignment with the recess 48 and the exhaust cam 42 and the decompression cam 43 are positioned in alignment with the recess 49. By following these steps, it can be prevented that a tappet 50 dropped on the base circle of the suction cam 41 interferes with the rib 44, or the suction cam 41, exhaust cam 42 and the decompression cam 43 interfere with the stopper portion 47 to make pulling out of the cam shaft 29 impossible, otherwise, the tappet 50 may fall down within the front and rear crankcases 3, 4 by accident and it becomes impossible to take out the tappet 50 in the front and rear crankcases 3, 4 unless the front crankcase 3 and the rear crankcase 4** are disassembled.

In FIG. 15, a supporting jig 80 for supporting the power unit P like a cantilever is shown. A distance between a connecting projection 81 and an under hole 82 of the supporting jig 80 is equal to the distance between the tip end part **73*a* of the engaging recess 73 and the attaching boss $8_L$. The supporting jig 80 can be integrally connected to the front and rear crankcases 3, 4 of the internal combustion engine E in such a manner that at first the connecting projection 81 of the supporting jig 80 is engaged with the engaging recess 73 being caught by the tip end part 73*a*, and then a pin (not shown) is inserted in the hole 82 of the supporting jig 80 and the attaching boss $8_L$. After that, the supporting jig 80** is pulled up while being given an anti-clockwise moment for supporting the power unit P like a cantilever.

Although the body frame B of the saddle type vehicle for off-road running A is formed in a loop in its side view and the channel-shape main frame $B_1$ exists above the power unit P, the power unit P can be installed in the vehicle A from one side of the vehicle without being obstructed by the main frame $B_1$ and mounted easily to the pipe-shape frame $B_2$ by means of the boss 8 and the elastic mount element 9.

Since the case upper surface portions 75, 76 at the left side of the cylinder opening 74 surrounded by the swelled clutch upper portion 77 and the swelled transmission upper portions 78, 79 are slanted gently downward from front to rear, rain water and the like can be drained naturally without staying on the case upper surface portions 75, 76.

What is claimed is:

1. A power unit to be mounted in a nearly central portion of a vehicle having a crankshaft and a plurality of transmission shafts directed in a running direction of the vehicle and supported rotatably within a case which is formed by integrally joining a crankcase of an internal combustion engine and a transmission case wherein:

a plurality of said transmission shafts are arranged on one side of said crankshaft and a cam shaft is rotatably supported at a position on the other side of, and adjacent to, said crankshaft;

a cylinder block and a cylinder head housing a valve moving device are positioned at an upper part of said crankcase and inclined from a position over said crankshaft to a position over said transmission shafts;

said cylinder head containing a cylinder axis is provided with an ignition plug on one side with respect to said cylinder axis and said valve moving device on other side thereof; and said valve moving device is arranged directly over said crankshaft.

2. A power unit for a vehicle as set forth in claim 1, wherein a boss for attachment to a body of the vehicle is provided on a lower part of said case, and an engaging recess directed laterally toward a center part of said case and having a tip end portion directed upwardly along said case is formed on a side of an upper part of said case.

3. A power unit for a vehicle as set forth in claim 1, wherein said power unit has a propeller shaft for connecting the power unit with a driving wheel of the vehicle.

* * * * *